US008794562B2

(12) United States Patent
Day et al.

(10) Patent No.: US 8,794,562 B2
(45) **Date of Patent: *Aug. 5, 2014**

(54) MANDREL CUPPING ASSEMBLY

(75) Inventors: Jason William Day, Loveland, OH (US); Fredrick Edward Lockwood, Cincinnati, OH (US); Joern Ralph Karsten, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 469 days.

This patent is subject to a terminal disclaimer.

(21) Appl. No.: 13/272,303

(22) Filed: Oct. 13, 2011

(65) Prior Publication Data

US 2013/0092784 A1 Apr. 18, 2013

(51) Int. Cl.
*B65H 19/30* (2006.01)
*B65H 19/22* (2006.01)

(52) U.S. Cl.
CPC .. *B65H 19/2223* (2013.01); *B65H 2301/41362* (2013.01); *B65H 2403/51* (2013.01)
USPC ..... 242/533.4; 242/533.5; 242/559.2

(58) Field of Classification Search
USPC ..... 242/533.2, 533.4, 533.5, 533.6, 559.1, 242/559.2
See application file for complete search history.

(56) References Cited

U.S. PATENT DOCUMENTS 2,066,659 A * 1/1937 Clouse et al. ..... 242/571.8
2,082,031 A * 6/1937 Schultz et al. ..... 242/573.4
2,703,681 A * 3/1955 Jacobs ..... 242/555.5
2,769,600 A * 11/1956 Nystrand et al. ..... 242/530.1
3,063,347 A * 11/1962 Cummings ..... 493/106
3,289,552 A * 12/1966 Corazzo ..... 493/107
3,381,911 A * 5/1968 Franz Held et al. ..... 242/527.3
3,599,892 A * 8/1971 Brouwer et al. ..... 242/559.2
3,613,571 A * 10/1971 Russell et al. ..... 101/40
3,635,415 A * 1/1972 Phelps et al. ..... 242/533.6
3,761,032 A * 9/1973 Bahnsen ..... 242/532.2
3,871,595 A * 3/1975 Smolderen ..... 242/527.4
4,266,735 A * 5/1981 Leanna et al. ..... 242/533.5
4,327,876 A * 5/1982 Kuhn ..... 242/527.4
4,516,742 A * 5/1985 Townsend ..... 242/533.5
4,588,138 A * 5/1986 Spencer ..... 242/533.6
4,635,871 A 1/1987 Johnson et al.
4,773,609 A * 9/1988 Steffen et al. ..... 242/559.1
4,871,124 A * 10/1989 Hugo et al. ..... 242/532
4,911,375 A * 3/1990 Knop ..... 242/596.6
4,993,652 A * 2/1991 Moeller ..... 242/527.3
5,330,116 A * 7/1994 Meyer ..... 242/533.2
5,417,382 A * 5/1995 Petitjean et al. ..... 242/527

(Continued)

*Primary Examiner* — Emmanuel M Marcelo
*Assistant Examiner* — Michael Gallion
(74) *Attorney, Agent, or Firm* — Peter D. Meyer

(57) ABSTRACT

A mandrel cupping assembly for releaseably enraging the ends of a plurality of mandrels supported on a web winding turret assembly is disclosed. The turret assembly provides a plurality of mandrels extending parallel to a turret assembly central axis and driven in a closed mandrel path about the turret assembly central axis. The mandrel cupping assembly provides a cupping arm cooperatively associated with each mandrel, a cupping arm support having a hold-open cam track and a hold-closed cam track disposed radially about a surface thereof, and a first actuator for disposing the cupping arm from the hold-open cam track to the hold-closed cam track. The cupping arm has a mandrel cup for releaseably engaging the end of a mandrel. Each cupping arm is carried in a radial path about the turret assembly central axis while disposed in either of the hold-open cam track or the hold-closed cam track.

19 Claims, 13 Drawing Sheets

(56) References Cited

U.S. PATENT DOCUMENTS

| | | | | | |
|---|---|---|---|---|---|
| 5,435,501 | A | * | 7/1995 | Alexander et al. | 242/533.8 |
| 5,667,162 | A | * | 9/1997 | McNeil et al. | 242/533.4 |
| 5,725,176 | A | | 3/1998 | Vigneau | |
| 5,732,901 | A | * | 3/1998 | McNeil et al. | 242/533.4 |
| 5,845,867 | A | * | 12/1998 | Hould et al. | 242/527 |
| 5,899,404 | A | * | 5/1999 | McNeil et al. | 242/533.4 |
| 5,913,490 | A | * | 6/1999 | McNeil et al. | 242/533.4 |
| 5,934,602 | A | * | 8/1999 | Jendroska et al. | 242/533.6 |
| 6,129,304 | A | * | 10/2000 | Biagiotti | 242/530.1 |
| 6,354,530 | B1 | * | 3/2002 | Byrne et al. | 242/533.5 |
| 6,595,459 | B2 | | 7/2003 | Hanson | |
| 7,204,448 | B2 | * | 4/2007 | Heikaus | 242/533.4 |
| 7,536,763 | B2 | | 5/2009 | Offerhaus | |
| 2003/0160127 | A1 | * | 8/2003 | Wojcik et al. | 242/531 |
| 2005/0077416 | A1 | * | 4/2005 | Heikaus | 242/533.4 |
| 2006/0124719 | A1 | * | 6/2006 | Mannlein | 229/403 |
| 2006/0137501 | A1 | * | 6/2006 | Damo | 83/277 |
| 2007/0278342 | A1 | | 12/2007 | Harkins | |
| 2008/0105776 | A1 | * | 5/2008 | Wojcik et al. | 242/366.3 |
| 2009/0134264 | A1 | * | 5/2009 | Simonelli et al. | 242/530.1 |
| 2010/0320307 | A1 | | 12/2010 | Pappas et al. | |

* cited by examiner

MANDREL CUPPING ASSEMBLY

FIELD OF THE INVENTION

The present disclosure relates to automatic web rewinding machines where paper towel stock, bath tissue stock, or the like unwound from very large parent rolls is rewound into small individual rolls. In particular, the present disclosure relates to an apparatus that releasably attaches a mandrel cup into and out of supporting engagement with the free end of a mandrel prior to the winding of the web material upon the mandrel and subsequently detaching the mandrel cup from the mandrel so that the wound web material can be removed from the mandrel for additional processing.

BACKGROUND OF THE INVENTION

Typical web rewinding machines provide a number of core supporting mandrels ranging anywhere from four to ten in number which are mounted on an indexingly rotatable turret. The mandrels extend parallel to the horizontal axis about which the turret rotates, and they are spaced at equal distances from the turret axis and at uniform intervals around that axis. By way of example, a typical six-mandrel turret moves through one-sixth of a revolution at each of its indexing movements and hence it carries each mandrel in turn to each of the six successive stations with a period of dwell at each station. By way of yet another example, an exemplary eight-mandrel turret moves through one-eighth of a revolution at each of its indexing movements and hence it carries each mandrel in turn to each of the eight successive stations with a period of dwell at each station. In any regard, it should be understood that the number of spindles disposed about any given turret used in a web rewinding machine would determine the number of successive stations in any such device.

In such a configuration, typically one station (sometimes called a first station) is a loading station at which a length of core stock is slid axially onto the mandrel. At the next station, the core stock has an adhesive or glue applied to the core. At the third station, the mandrel is brought up to winding speed. As the mandrel moves from the third to the fourth station, the web material is attached to the glued core disposed upon the mandrel for the beginning of the winding operation. Winding continues while the mandrel is at the fourth station. As the mandrel moves out of the fourth station, the web material is cut through across its width (or cross-machine direction) to sever it from the wound roll of web material (e.g., the source of the web material) and give it a new leading edge that is attached to a new core on the next mandrel moving into the winding station. At the fifth station, the rotation of the mandrel is decelerated to a stop, and at the sixth station a wound core or log is stripped off the mandrel. The mandrel then moves to the first station for a repetition of the cycle.

A conventional turret by which the mandrels are carried comprises a spider which is mounted for a rotation on a coaxial shaft that projects a substantial distance in one direction from the spider. The mandrels have rotating connections with the spider, and they project from it in the same direction as the turret shaft. The rotating connection of each mandrel with the spider must provide cantilevered support of the mandrel because when the mandrel is at the core loading station and the unloading station, the end of the mandrel that is remote from the spider has to be accessible to allow cores to be moved axially onto and off it should be recognized that to the mandrels tend to be heavy and very long—typically, 72 inches to 96 inches in length. Therefore, their free ends are typically be supported whenever possible and certainly during winding.

To provide support of the free ends of the mandrels, there is conventionally an assembly of supporting arms or chucks on the end portion of the turret shaft that is remote from the spider. This is also known to those in the art as a mandrel cupping assembly. A mandrel cupping assembly is an assembly that is constrained to indexing rotation concurrent with the spider containing the individual mandrels. The mandrel cupping spider generally comprises a chuck arm (or cup) cooperatively associated with each mandrel. Each chuck arm is generally swingable about an axis which is near the turret axis and transverse thereto between a substantially radially extending closed position in which the free end of the chuck arm supportingly engages the free end portion of its associated mandrel and an open position in which the chuck arm is disengaged from its mandrel and is disposed in a more or less axial orientation alongside the turret shaft. Each chuck arm is operated automatically so that it is in its open position during loading and unloading of the mandrel and is in its closed position at least from the time the mandrel moves into the gluing station and moves out of the deceleration station mentioned supra.

In one embodiment, a conventional mechanism for actuating the mandrel supporting chuck arms is provided with a barrel cam that is fixed to the machine frame adjacent to the free ends of the mandrels and a lever and link arrangement for each chuck arm. Each arrangement is carried by the turret for rotation therewith and having a cam follower roller that rides in a groove in the periphery of the stationary barrel cam. Each chuck arm is actuated at appropriate times in consequence of indexing movement of the turret. The shape of the cam groove is provided so that the chuck arms move into engagement with their respective mandrels when the latter are generally adjacent the glue applicator wheels and retract when the mandrels move from the web material winding position.

In such an operation, the stripping of wound rolls off a mandrel is conventionally accomplished by means of a pusher that engages the log at only one side of the mandrel and provides a lateral force upon the cantilevered mandrel. This can set the mandrel into a vibration mode that may be aggravated by the indexing movement that follows unloading. With the mandrel unsupported at the loading station, its free end often wobbles so severely that the core may not be run onto it with automatic core loading equipment. Such an apparatus is described in U.S. Pat. No. 2,769,600.

It is believed that with such conventional machines, the failure to load a core creates a danger that the mandrel itself would be coated with glue at the gluing station necessitating a lengthy shutdown of the machine for cleaning. An operator, seeing that such an unloaded core was moving out of the unloading station, would be required to stop the machine and would find that there is no way to retract the chuck arm engaged with the empty mandrel to permit manual axial unloading of the core. This is because of the nature of the chuck arm actuating mechanism. One purported solution to this problem was to slit a core along its length and push it laterally onto a mandrel to protect the mandrel from glue. At the conclusion of the winding cycle the individual rolls wound onto the gifted core are then discarded.

It is also believed that wobble of an unsupported mandrel could cause a chuck aim to fail to engage the mandrel properly. One solution proposed was a U-shaped member on each chuck arm that tended to preliminarily engage the mandrel during closing movement of the chuck arm and steady the mandrel sufficiently to enable its conical free end to be received in the bearing socket disposed in the chuck arm. However, it is believed that this expedient is not always successful in practice because as the wobbling mandrel fails to enter the chuck arm socket, the chuck arm mechanism exerts as much force as the indexing mechanism can provide. This can result in the inevitable bending or breakage of the link and lever elements that translate any cam follower motion into swinging motion of the chuck arm. The repair of such damage would be necessarily difficult and time consuming.

It is also believed that another expedient that has been used to prevent damage to the chuck arm actuating mechanism is to mount the barrel cam for limited axial motion and pneumatically bias it towards one limit of such motion. When a chuck arm fails to close properly, the reaction force that is imposed upon the cam moves it against its bias to a position which actuates an emergency stop. However, it is believed that such an emergency shutdown arrangement merely relieves some of the effects of the problem rather than solving the problem itself. By way of example, it will not permit axial loading of a core onto an empty mandrel that had moved out of the loading position.

Other solutions provide an automatic web rewinding machine or an automatic mandrel chucking mechanism that does not employ force derived from the turret indexing to affect chuck arm actuation. The chuck arms move to and from their mandrel supporting positions only during periods of dwell to minimize the likelihood of mandrel vibration at the time chuck arm closing occurs. The mechanism is arranged to allow a chuck arm to be manually controlled for movement to its open position in any position of the turret so that a core can be axially loaded onto an empty mandrel or a defective core or roll can be axially stripped off the mandrel. Such a system is described in U.S. Pat. No. 4,266,735.

In any regard, attempts by the prior art to achieve an automatic web rewinding machines all provide for a single chuck arm and it associated equipment to be cooperatively associated with a respective mandrel. Further, the chuck arm and its associated equipment must cooperatively rotate with the mandrel about the turret axis. In other words, a chuck arm is constrained to rotate with the turret and is movable relative to and between a closed position (in which the chuck arm supportingly engages the other end of the mandrel) and an open position (in which the chuck arm is disengaged from the mandrel) to permit cores to be moved axially onto and off it. Clearly, the mechanism is unduly complex and requires numerous moving parts and associated ancillary equipment for it to perform its intended function.

Thus, it would be clearly advantageous to provide a turret system and in particular, a mandrel cupping assembly that is less complex and requires fewer moving parts to perform its intended function. In fact, such system would rotate only the mandrel cup with its respective mandrel free of any associated equipment necessary to load and unload the mandrel cup. Clearly, such systems would be appreciated by one of skill in the art because of their overall simplicity and ease of use.

SUMMARY OF THE INVENTION

One exemplary embodiment of the present disclosure provides a mandrel cupping assembly for releaseably engaging the ends of a plurality of mandrels supported on a web winding turret assembly. The turret assembly provides a plurality of mandrels extending parallel to a turret assembly central axis and driven in a closed mandrel path about the turret assembly central axis. The mandrel cupping assembly provides a cupping arm cooperatively associated with each mandrel, a cupping arm support having a hold-open cam track and a hold-closed cam track disposed radially about a surface thereof, and a first actuator for disposing the cupping arm from the hold-open cam track to the hold-closed cam track. The cupping arm has a mandrel cup for releaseably engaging the end of a mandrel. Each cupping arm is carried in a radial path about the turret assembly central axis while disposed in either of the hold-open cam track or the hold-closed cam track.

DETAILED DESCRIPTION OF THE INVENTION

Figure 1:
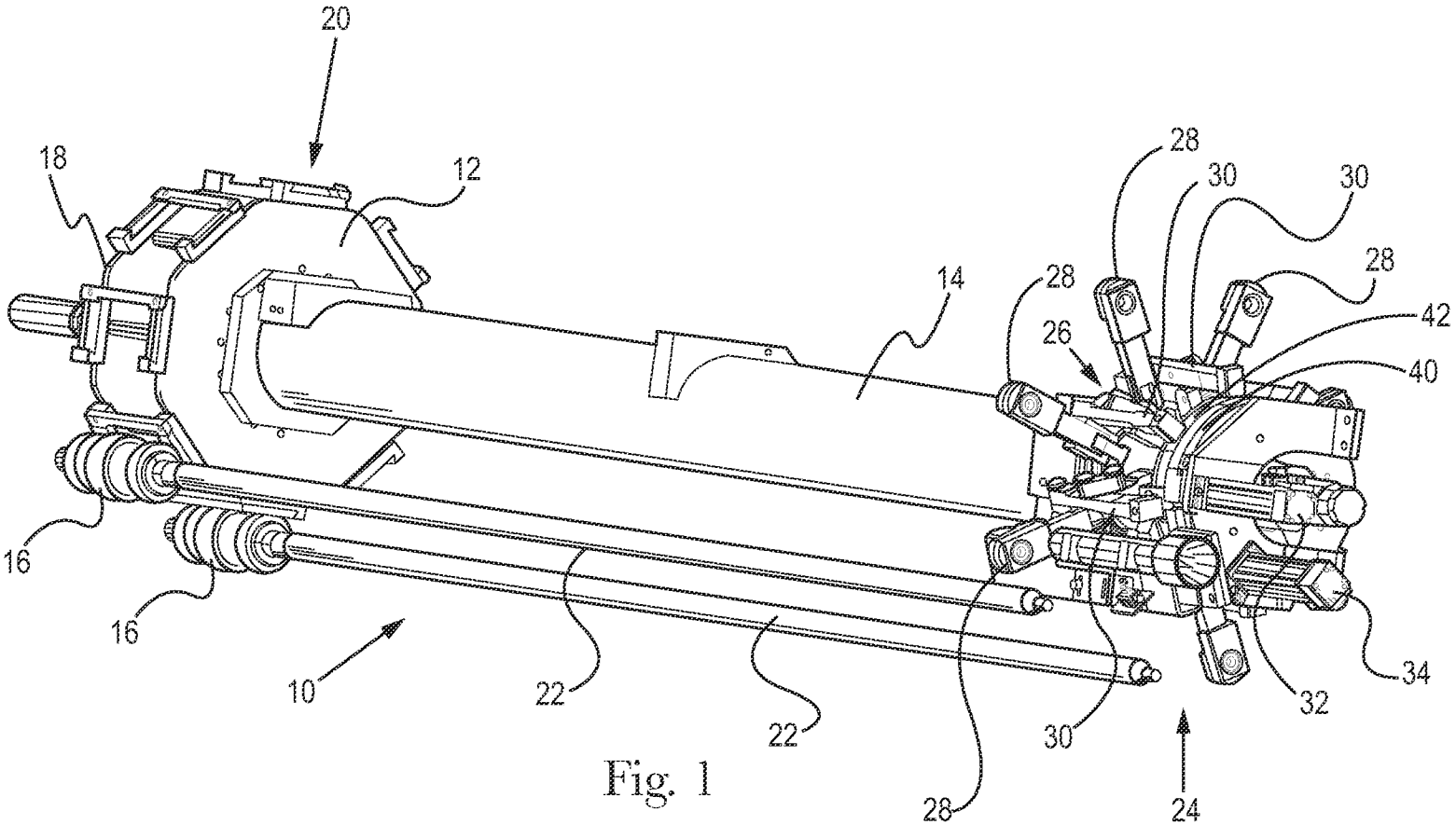
FIG. 1 is partial perspective view of an exemplary web rewinding machine showing only two mandrels and utilizing the exemplary mandrel cupping assembly of the present disclosure.

FIGS. 1-4 of the present disclosure depict various perspective views of an exemplary web rewinding machine 10 and a portion of an exemplary, non-limiting embodiment of a turret assembly 20 suitable for use as an automatic web rewinding machine. A plurality of rotatable core supporting mandrels 22 are carried for indexable, orbitable motion as well as for rotation about their own respective axes. A typical turret assembly 20 provides a spider (12) by which the respective mandrels 22 are carried and a shaft (14) by which the spider (12) is supported for rotation. The turret shaft (14) projects a substantial distance in one direction from the spider (12) and the mandrels 22 disposed thereupon project hum the spider (12) a somewhat smaller distance in the same direction. Since the rotatable connection between the spider (12) and each of the long, relatively heavy mandrels 22 is near one end of the mandrel 22 and the other end of the mandrel 22 will be unsupported at times, the spider (12) carries two axially spaced apart bearings (16) for each mandrel so that the cantilevered connection of the mandrel 22 with the spider (12) can, by itself, hold the mandrel 22 reasonably steady. As will be appreciated by one of skill in the art, it is preferred that each mandrel 22 be provided equidistant from the axis of the turret and are uniformly spaced about that axis.

Each mandrel 22 can be driven for the rotation in any conventional manner. One form of a mandrel drive apparatus can provide rotation of each mandrel 22 and its associated core 2 about the mandrel axis 2 during movement of the mandrel 22 and core. The mandrel drive apparatus can provide winding of a web material upon the core supported on the mandrel 2 to form a log 46 of web material wound around the core (a web wound core). This form of mandrel drive apparatus can provide center winding of the web material upon the cores (that is, by connecting the mandrel with a drive which rotates the mandrel 22 about its axis, so that the web material is pulled onto the core.

As one of skill in the art will appreciate, each mandrel 22 can be connected at its end adjacent to the spider (12) with a form of coaxial clutch that provides a disengageable driving connection between the mandrel and a coaxial sheave. Typically, the sheave is connected by means of a belt with a pulley and is rotatable on the turret shaft and in turn a belt drivingly connects the pulley with a motor which can be provided at a fixed location relative to the frame of the turret assembly 20. Such assemblies are described in U.S. patent application Ser. No. 06/113,465.

Further, one of skill in the art will appreciate that a turret assembly 20 having a turret (18) is typically indexingly rotated to carry each of the mandrels 22 to each of a succession of fixed stations at each of which the mandrel dwells for a time during the performance of an operation distinctive to the particular station. The arrangement of the stations, the operation or operations at each, and the apparatus provided at the several stations for the performance of their function are all generally known to those of skill in the art familiar with web rewinding machines.

In one exemplary, but non-limiting embodiment, each mandrel 22 can be provided with a toothed mandrel drive pulley 38 and a smooth surfaced, free wheeling idler pulley, both disposed near the at its end adjacent to the spider (12). The positions of the drive pulley and idler pulley alternate on every other mandrel 22, so that alternate mandrels 2 are driven by their respective mandrel drive belts. For instance, when a mandrel drive belt engages the mandrel drive pulley on its associated mandrel 22, the mandrel drive belt can ride over the smooth surface of the idler pulley on that same mandrel 22, so that only the respective drive motor provides rotation of that mandrel 22 about its axis. Similarly, when the mandrel drive belt engages the mandrel drive pulley on an adjacent mandrel 22, the mandrel drive belt can ride over the smooth surface of the idler pulley on that respective mandrel 22, so that only that drive motor provides rotation of the mandrel about its axis. Accordingly, each drive pulley on an associated mandrel 22 engages one of the belts to transfer torque to the mandrel, and the idler pulley engages the other of the belts, but does not transfer torque from the drive belt to the mandrel.

As would also be understood by one of skill in the art, a length of tubular core stock from a supply thereof is advanced axially by known mechanisms to be loaded onto a particular mandrel 22. Typically, a mandrel 22 has a conical or bullet nose free end portion to assist in guidance of the cores into a coaxially relationship thereto.

Similarly, after the winding of a web material into a wound product 46 upon a mandrel 22, a generally conventional mandrel unloading mechanism provides the individual rolls of wound product 46 to be stripped off a mandrel 22 at an unload station. In one embodiment, the unloading mechanism may comprise an endless belt arranged to have a long, straight stretch which extends parallel to the mandrel 22 at the unloading station at a small distance to one side of that mandrel 22. A pusher can be secured to the belt and projects laterally therefrom to engage behind a log of wound product 46 and drive it off the mandrel 22 as the pusher moves away from the spider along a straight stretch.

Alternatively, a core stripping apparatus can be positioned along the unload station. An exemplary core stripping apparatus can comprise a driven core stripping component, such as an endless conveyor belt. The conveyor belt preferably carries a plurality of flights spaced apart on the conveyor belt. Each flight, can engage the end of a log 46 supported on a mandrel 22 as the mandrel 2 along the unload station.

A flighted conveyor belt can be angled with respect to a respective mandrel 22 axis as the mandrels 22 are carried along a generally straight line portion of the core unload station so that the flights engage each log 46 with a first velocity component generally parallel to the mandrel 22 axis, and a second velocity component generally parallel to the straight line portion of the unload station. Once the log 46 is stripped from the mandrel 22, the mandrel 22 can be carried along the closed mandrel path to the core loading station to receive another core.

As shown generally in FIGS. 1-4 and with more particularity in FIGS. 5-10, one of skill in the art will recognize that during both unloading and loading of a mandrel 22, the end that is remote from the spider must be unsupported. However, as the mandrel moves through the portion of its orbit that takes it from the loading station around to an unloading station, its free end portion is supported by means of a cupping assembly 24 having cupping arms 28 disposed about a cupping spider 26 that are placed into contacting and uncontacting engagement with the free end of the mandrel 22. In other words, a mandrel cup 28 releaseably engages the unsupported end of a mandrel 22, and supports the mandrel 2 for rotation of the mandrel about its axis.

In a preferred embodiment, a particular cupping arm 28 is cooperatively associated with each mandrel 22. The mandrel cupping assembly 24 releaseably engages the unsupported ends of the mandrels 22 intermediate the core loading segment and the core stripping segment of the closed mandrel path as the mandrels are driven around the turret assembly 20 axis by the rotating turret assembly 20.

In certain embodiments, when a turret assembly 20 comprises four mandrels 22, naturally there will be four cupping arms 28 disposed radially about cupping spider 26—each cupping arm 28 providing cooperative engagement with each respective mandrel 22. Similarly, a turret assembly 20 having six, eight, or ten mandrels 22 disposed thereabout, a cupping assembly 24 will have six, eight, or ten respective cupping arms 28 disposed radially about cupping spider 26, in any regard, each mandrel 22 associated with turret assembly 20 is provided with a corresponding cupping arm 28 disposed upon cupping spider 26 of cupping assembly 24. Each cupping arm 28 rotates about, and transverse to, the rotating axis of cupping spider 26. Such rotary motion carries a respective cupping arm 28 to rotate about the axis of cupping assembly 24 in either hold-open track 40 (or hold-open cam track 40) or hold-closed track 42 (or hold-closed cam track 42). As used herein a "track" is to be broadly construed to provide a line for travel or motion for sliding or rolling a part or parts. As such, a "track" may include any device, apparatus, or assembly that prevents the unwanted movement from one portion of a device or assembly to another and/or. Non-limiting examples of various tracks may include a race, a cam, a trace, a channel, groove, or the like all of which are used interchangeably and combineably herein without limitation. It should be noted that hold-closed cam track 42 provides the cupping arm 28 in a closed operative position in which it supportingly engages the free end portion of mandrel 22 of turret assembly 20 and extends substantially radially to the shaft supporting turret assembly 20. Further, the rotary motion of cupping arm 28 can be provided in an open position in which the cupping arm 23 is disengaged from its respective mandrel.

Generally, cupping arm 28 should remain in a radially up-right position relative to hold-closed cam track 42 when in contacting engagement with a respective mandrel 22 of turret assembly 20. When cupping arm 28 is not in contacting engagement with a respective mandrel 22 of turret assembly 20, cupping arm 28 may reside in any position relative to hold-open cam track 42 including any position that is disposed radially away from mandrel 22.

Each cupping arm 28 is generally provided with a ring at an end distal from cupping spider 26 and the axis from which cupping assembly rotates and comprises a bearing socket in which the generally conical end portion of the mandrel 22 is receivable. The disposition of each cupping arm 28 into either one of hold-open cam track 40 or hold-closed cam track 42 as defined by cupping actuator 32 or un-cupping actuator 34, respectively, through respective chucking lever 30 and either cupping shuttle 36 or un-cupping shuttle 38. It is surprising to note that the cupping assembly 24 of the present disclosure only requires the use of two actuators in order to provide engagement of a respective cupping arm 28 with a mandrel 22 cooperatively associated thereto. It is also important to understand that the cupping actuator 32 and un-cupping actuator 34 of the present cupping assembly 24 do not rotate with a respective cupping arm 28 and the associated ancillary equipment such as chucking lever 30. It should also be noted that a "shuttle" as used herein can comprise any mechanism that moves a cam follower from one position to another (e.g., from one track to another and the like).

The cupping assembly 24 is designed to be utilized with a single cupping actuator 32 and a single un-cupping actuator 34 that extend and retract either a cupping shuttle 36 or un-cupping shuttle 38 to transfer the cupping arm 28 from the hold-open cam track 40 to the hold-closed cam track 42. In a preferred but non-limiting embodiment, the respective cupping shuttle 36 or un-cupping shuttle 38 pushes on a cam follower attached to a linkage cooperatively associated with the respective arm 28 where the respective cupping arm 28 is one of the portions of the linkage. One of skill in the art will readily appreciate the fact that using only two actuating devices (cupping activator 32 and un-cupping activator 34) greatly reduces the need for having a respective activation device for each cupping arm 28 that may be associated with a cupping assembly of the prior art. Further, it will be readily appreciated by one of skill in the art as clearly advantageous in having such a cupping assembly 24 having only two actuating devices (cupping activator 32 and un-cupping activator 34) in that such a system can allow cupping and un-cupping actions to occur at virtually any point of the rotation of turret assembly 20 and capping assembly 24. This can include, but clearly not be limited to, turret assembly 20 dwell, turret assembly index, or any combination of the two. This is clearly advantageous over conventional cam track systems that require cupping and un-cupping actions to occur only while the turret is in motion. Clearly, one of skill in the art will appreciate that the system of the present invention provides less complexity by allowing increased product turn-over rates, reduced maintenance and repair times, as well as reduced maintenance and repair costs.

Figure 10:
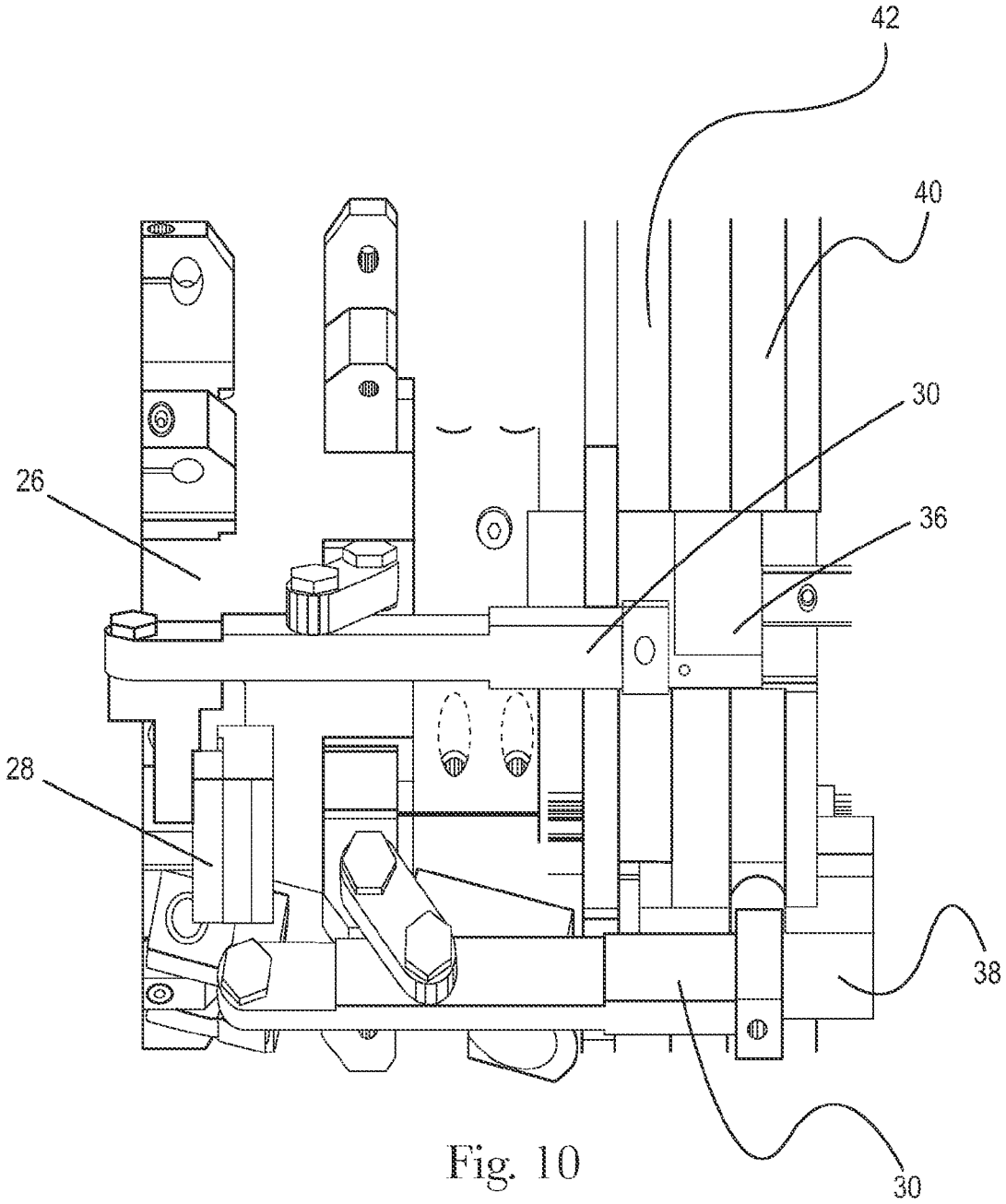
FIG. 10 is an exemplary expanded view of an engaged actuator showing the relationship between the engaged mandrel cup and the cam track of the mandrel cupping assembly.
Figure 11:
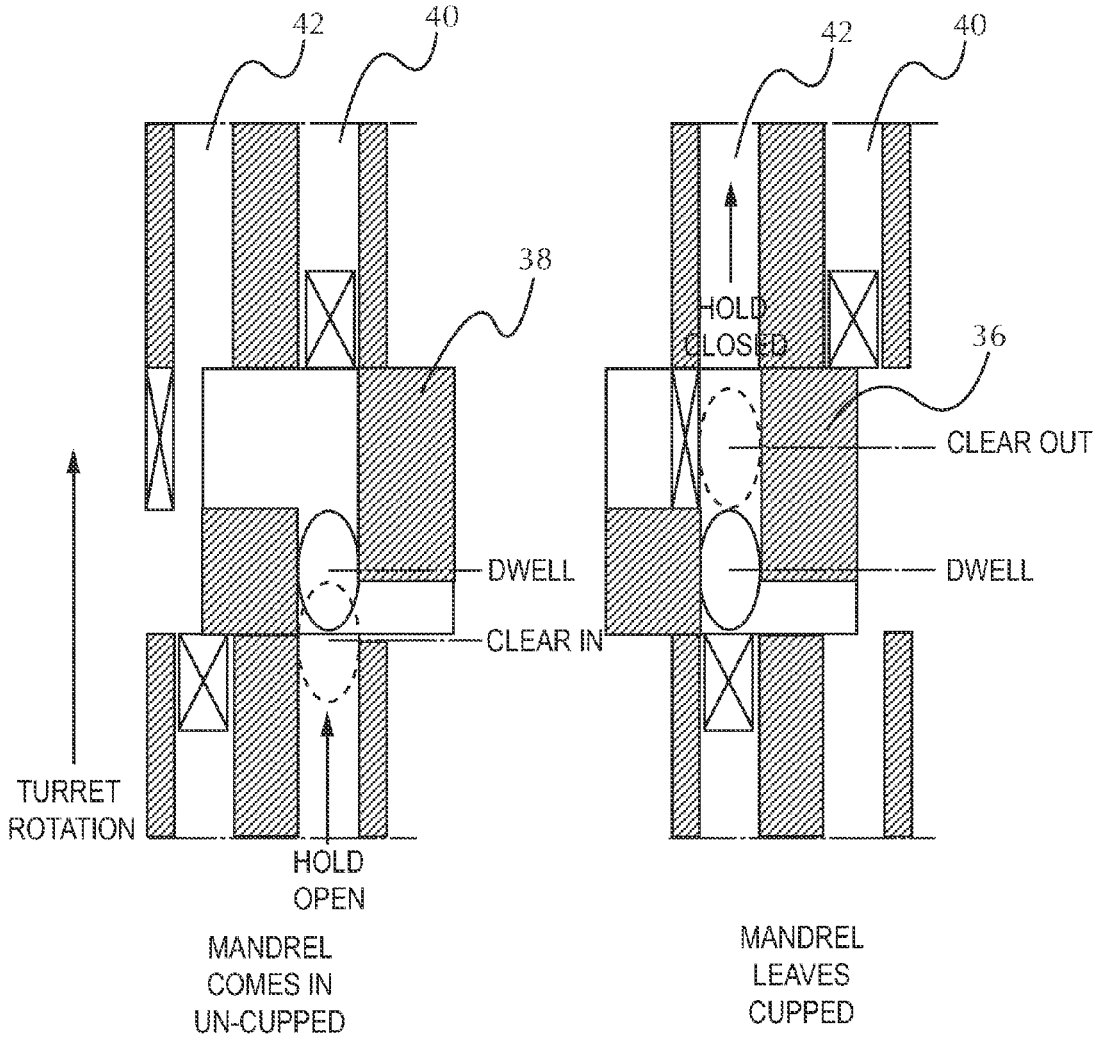
FIG. 11 is an expanded elevational view of an exemplary mandrel cupping assembly of the present disclosure showing the engagement of the cupping actuator relative to the hold-open and hold-closed cam tracks of the mandrel cupping assembly.

Referring to FIG. 11, an incoming cupping arm 28 cam follower generally rides in hold-open cam track 40. This ensures that the respective cupping arm 28 remains in the un-cupped position. Thus, one of skill in the art will understand that the cupping shuttle 36 should be in a fully retracted position before the cam follower proceeds past the position where the cupping activator 32 engages cupping shuttle 36, thereby engaging the respective chucking lever 30 to cause cupping arm 28 to engage the respective mandrel 22. In a preferred embodiment, the cam follower eventually reaches a dwell position while the cupping shuttle 36 is fully retracted. In such a dwell position, a core can be loaded onto the respective mandrel 22 and then the cupping shuttle 36 is directed inwardly toward the open end of the mandrel 22 in order to close the cup and fully support the previously unsupported end of the mandrel 22. The cupping shuttle 36 geometry and/or location preferably is designed to allow the turret assembly 20 to cup during dwell, turret index, or any combination of the two. Practically, this design allows more time to load a core onto a respective mandrel 22 and also facilitates higher turret assembly 20 turn-over speeds. The cupping shuttle 36 can begin to retract once the cam follower reaches a clear-out position. The cupping shuttle 36 should be in a fully retracted position before the next incoming cam follower approaches a clear in position as shown in FIG. 10.

One of skill in the art will appreciate that cupping arm 28 would comprise a feature that utilizes the cupping motion to actuate means for locking a core onto respective mandrel 22. By way of non-limiting example, the cupping motion may cause axial compression of a deformable ring disposed at the cupping end of respective mandrel 22. This compression forces the ring to expand radially, thereby locking the core onto respective mandrel 22. Further, the core can also be driven onto a core stop disposed proximate to the spider 12 end of turret assembly 20 prior to cupping. The core stop can be provided with tapered fins that are effectively wedged into the core wedged when loading. Effectively, such a tapered stop and expanding ring can combine to lock the core onto the respective mandrel 22 at both ends, providing a non-slipping drive engagement.

In another alternative, but non-limiting embodiment, the cupping motion could displace a moveable shaft disposed within the respective mandrel 22. Axial movement of the shaft would then cause locking pins disposed within respective mandrel 22 to protrude outside the outer diameter of the respective mandrel 22, thereby locking the core to the respective mandrel 22.

Figure 12:
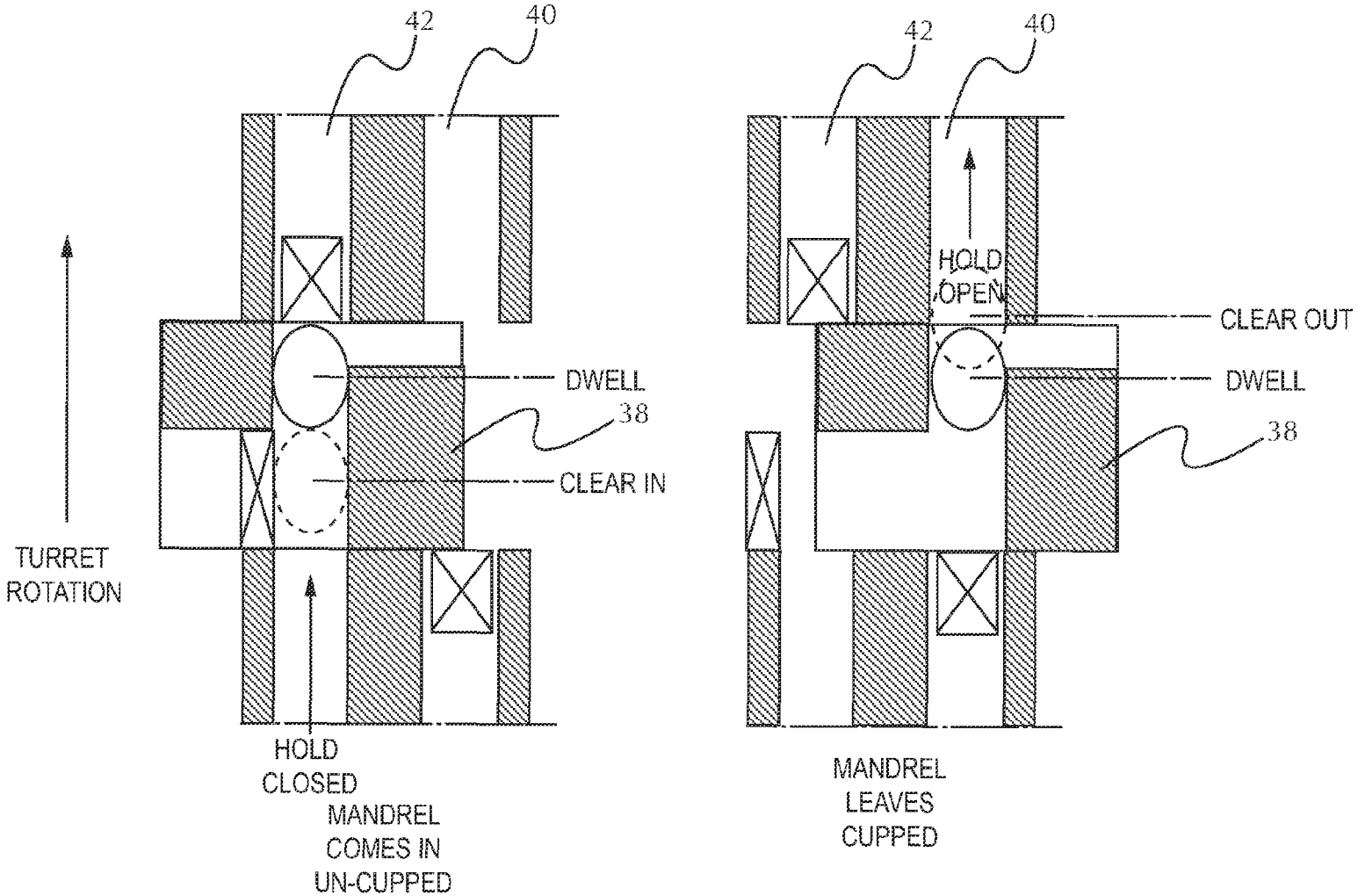
FIG. 12 is an expanded elevational view of an exemplary mandrel un-cupping assembly of the present disclosure showing the engagement of the cupping actuator relative to the hold-closed and hold-open cam tracks of the mandrel cupping assembly; and, FIG. 13 is an exemplary motion diagram showing the motion of an exemplary mandrel through an exemplary turret assembly.
Figure 13:
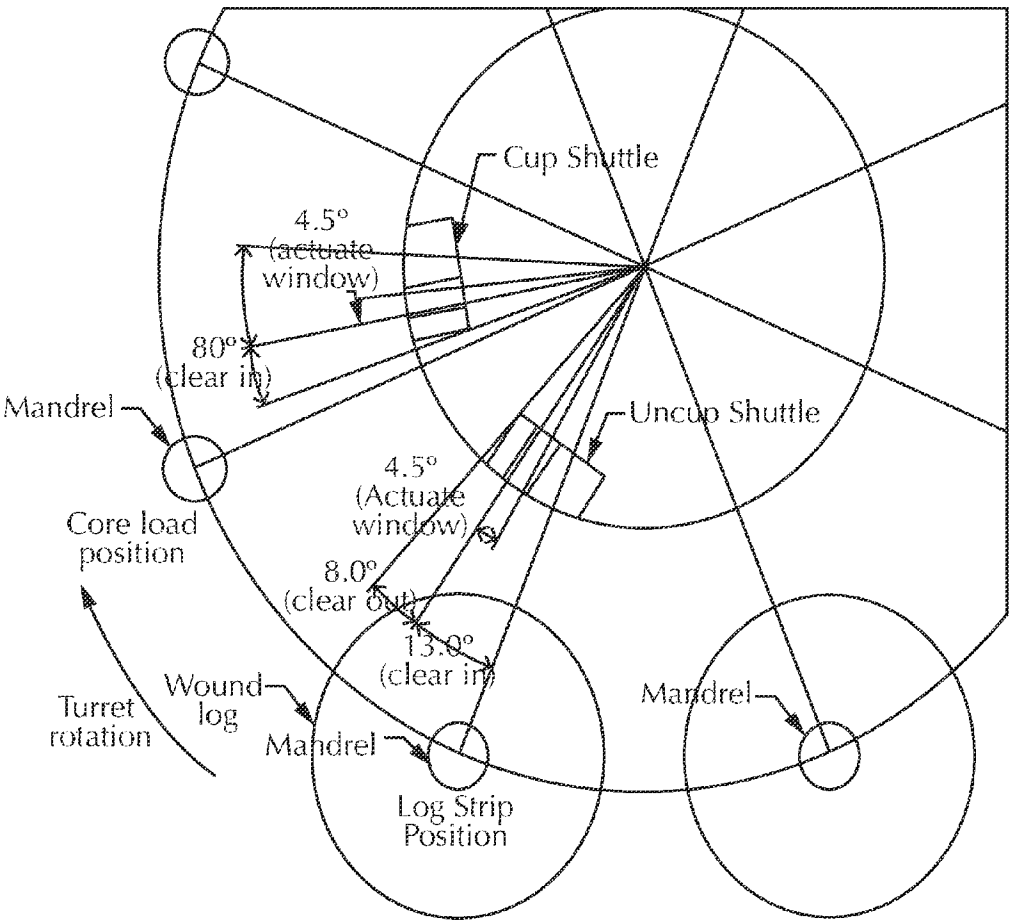

Referring to FIG. 12, when the cupping arm 28 reaches the dwell position, the un-cupping shuttle 38 retracts to essentially un-cup the mandrel 22 and leave the end of the mandrel 22 unsupported. While the mandrel 22 is uncapped at this position within turret assembly 20, the wound product 46 (which now forms what is known to those of skill in the art as a log) is stripped from the respective mandrel 22. The cupping shuttle 36 geometry and location is preferably designed to allow the turret assembly 20 to un-cup during dwell turret assembly 20 index or any combination of the two. The turret assembly 20 then begins to index and the un-cupping shuttle 38 begins to extend once the cupping arm 28 disposed within the hold-open cam track 40 reaches the clear-out position.

In a preferred embodiment, the un-cupping shuttle 38 is designed to maximize time to strip the log comprising wound product 46 from the mandrel 22 and to maximize turn-over for the placement of a new core upon mandrel 22. One of skill in the art will understand that the un-cupping shuttle 38 should be in the fully extended position before the next incoming cupping arm 28 disposed within hold-close cam track 42 gets beyond a clear-in position as shown in FIG. 11.

In a preferred embodiment, both cupping actuator 32 and un-cupping actuator 34 are provided as linear motors. However, one of skill in the art will understand that it would also be possible to provide an embodiment of the cupping assembly 24 where the cupping activator 32 and un-cupping activator 34 are provided as a four-port, two-position valve having an axially slideable valve element. In such an embodiment, both cupping activator 32 and un-cupping activator 34 can be operated by the use of compressed air or any other fluid suitable for use in such constructions. By providing cupping activator 32 and un-cupping activator 34 in linear relationship with cupping shuttle 36 and un-cupping shuttle 38, respectively, it is possible to provide a cupping assembly 24 that requires the use of only two activators to provide the intended function of cooperatively associating the unsupported end of the mandrel 22 with an individual cupping arm 28. However, it should be recognized that the cupping arm 28 and chucking lever 30 cooperatively associated thereto are disposed about the circumference of cupping spider 26 so that an individual cupping arm 28 is cooperatively associated with only one mandrel 22 of turret assembly 20.

An unloading mechanism (not shown) can be started as soon as the cupping arm 28 associated with the mandrel 22, wound product 46 disposed thereon, is reached its open position at the unloading station. Starting of the unloading mechanism can be coordinated with cupping arm 28 opening in any of several manners. For example, a start signal can be issued after a predetermined delay interval followed by the end of indexing motion. Alternatively, the unloading mechanism can be stopped at the end of each unloading operation in such a position that when restarted for the next operation, the pusher moves substantial distance before coming into engagement with wound product 46 disposed about mandrel 22 forming the outgoing log. In such a case, the unloading mechanism can be started in operation simultaneously with delivery of the opening input to the unloading station.

Figure 2:
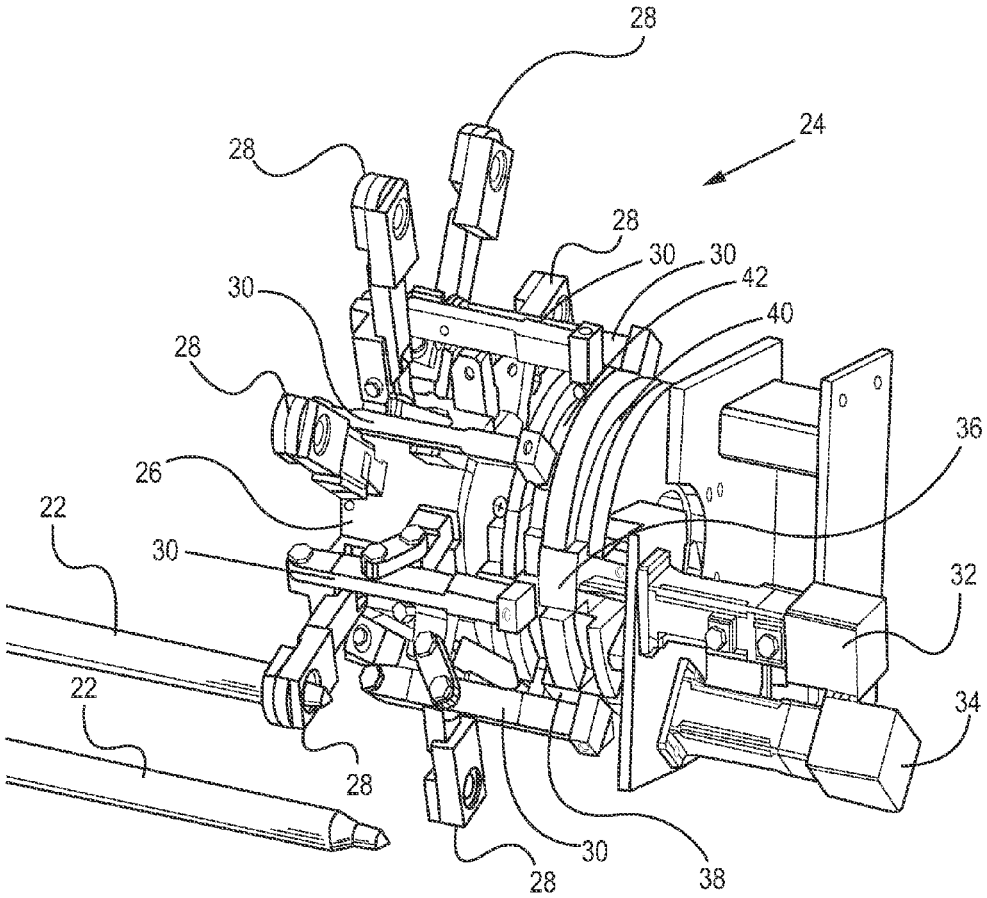
FIG. 2 is perspective view of an exemplary mandrel cupping assembly of the present disclosure showing a mandrel cooperatively associated thereto.
Figure 3:
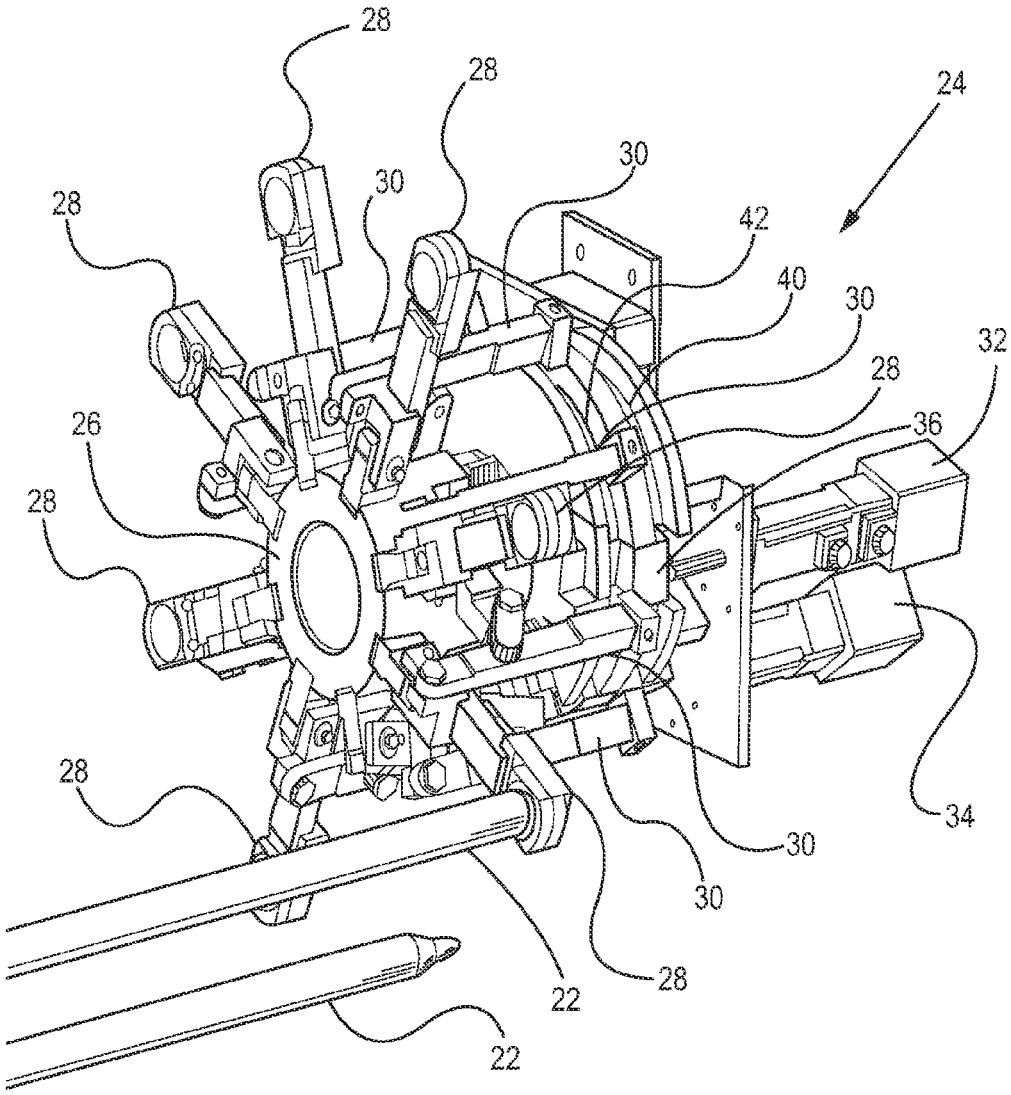
FIG. 3 is an alternative perspective view of an exemplary mandrel cupping assembly of the present disclosure showing a mandrel cooperatively associated thereto.
Figure 4:
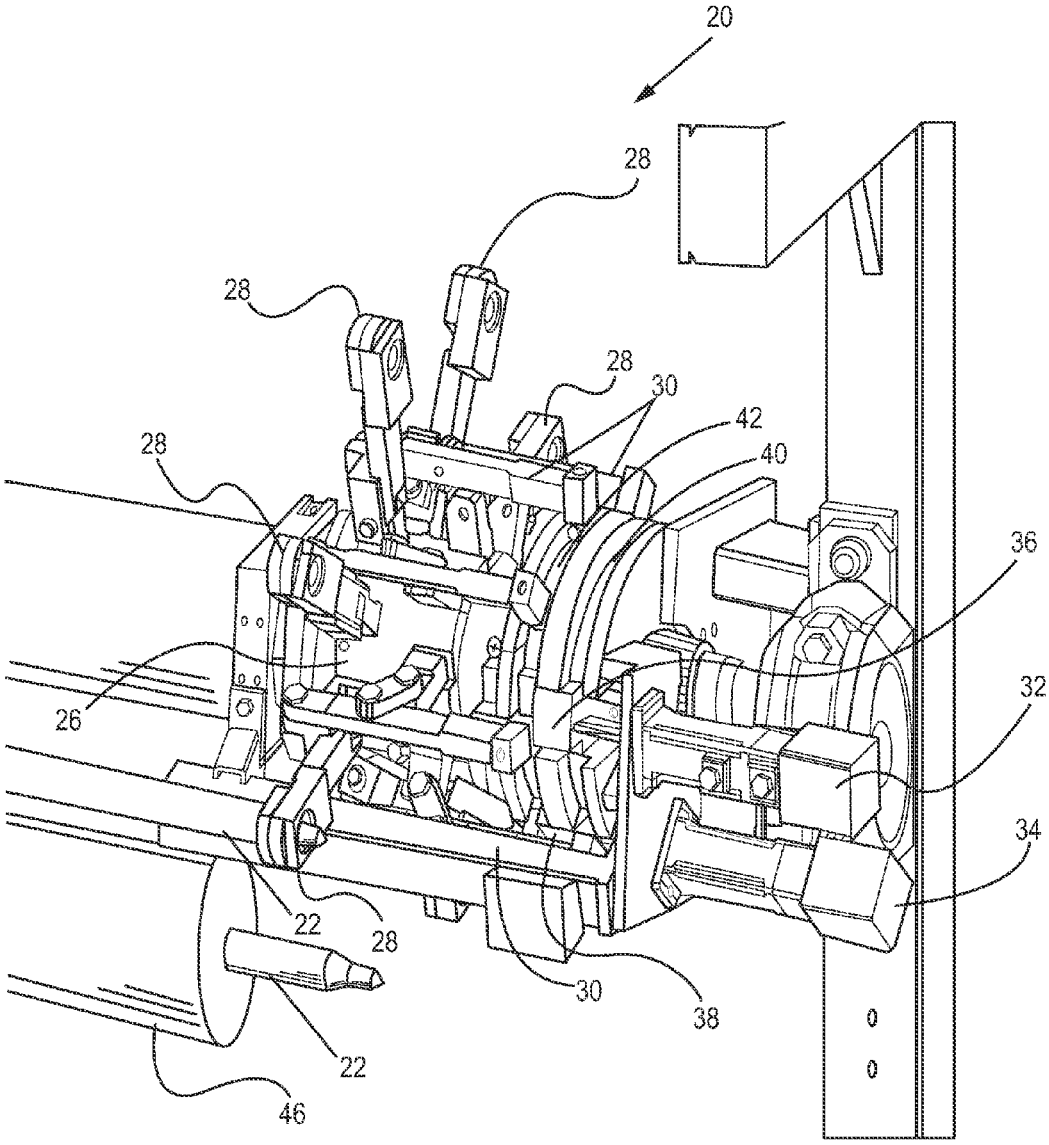
FIG. 4 is a perspective view of a portion of an exemplary turret mechanism having mandrels, some having a web material wound thereabout and an exemplary mandrel cupping assembly of the present disclosure cooperatively associated thereto.
Figure 5:
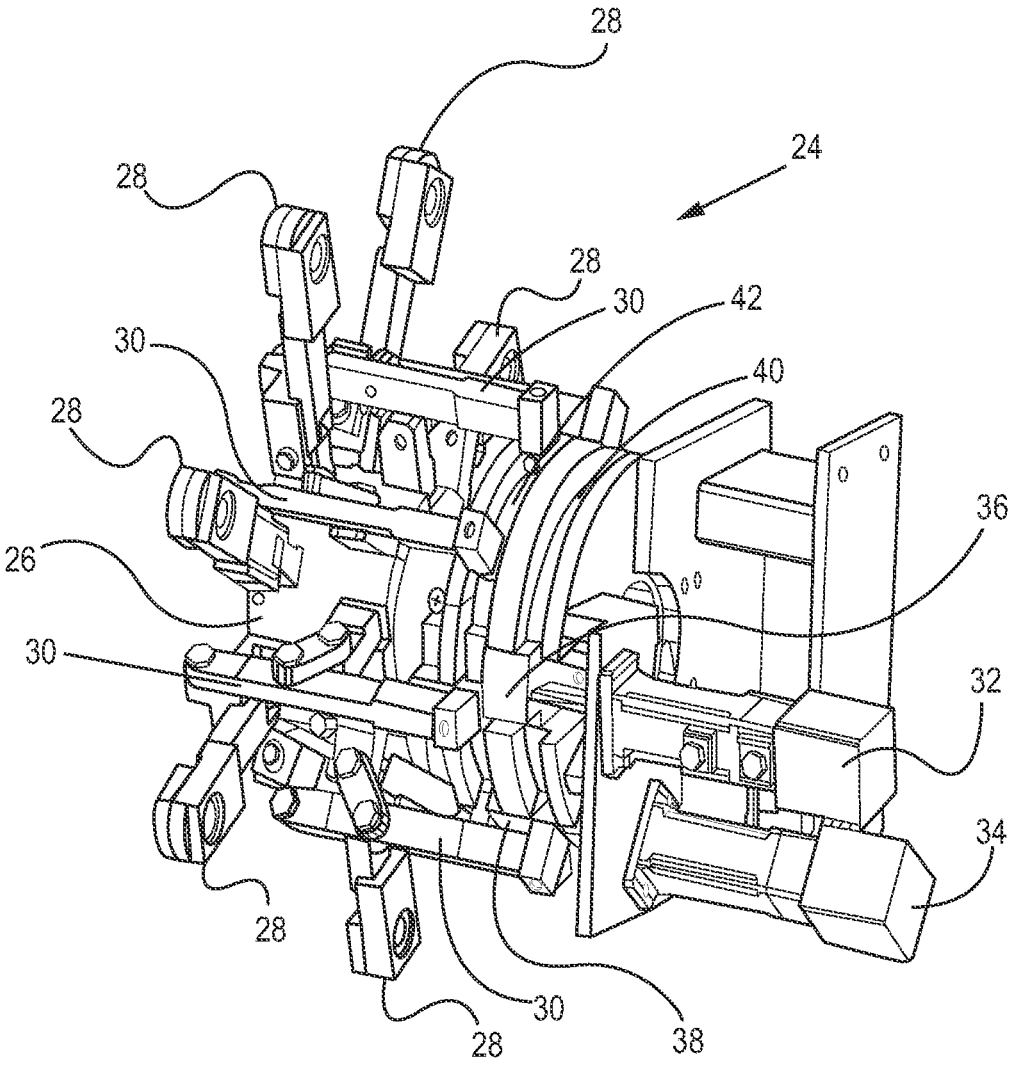
FIG. 5 is a perspective view of an exemplary mandrel cupping assembly of the present disclosure.
Figure 6:
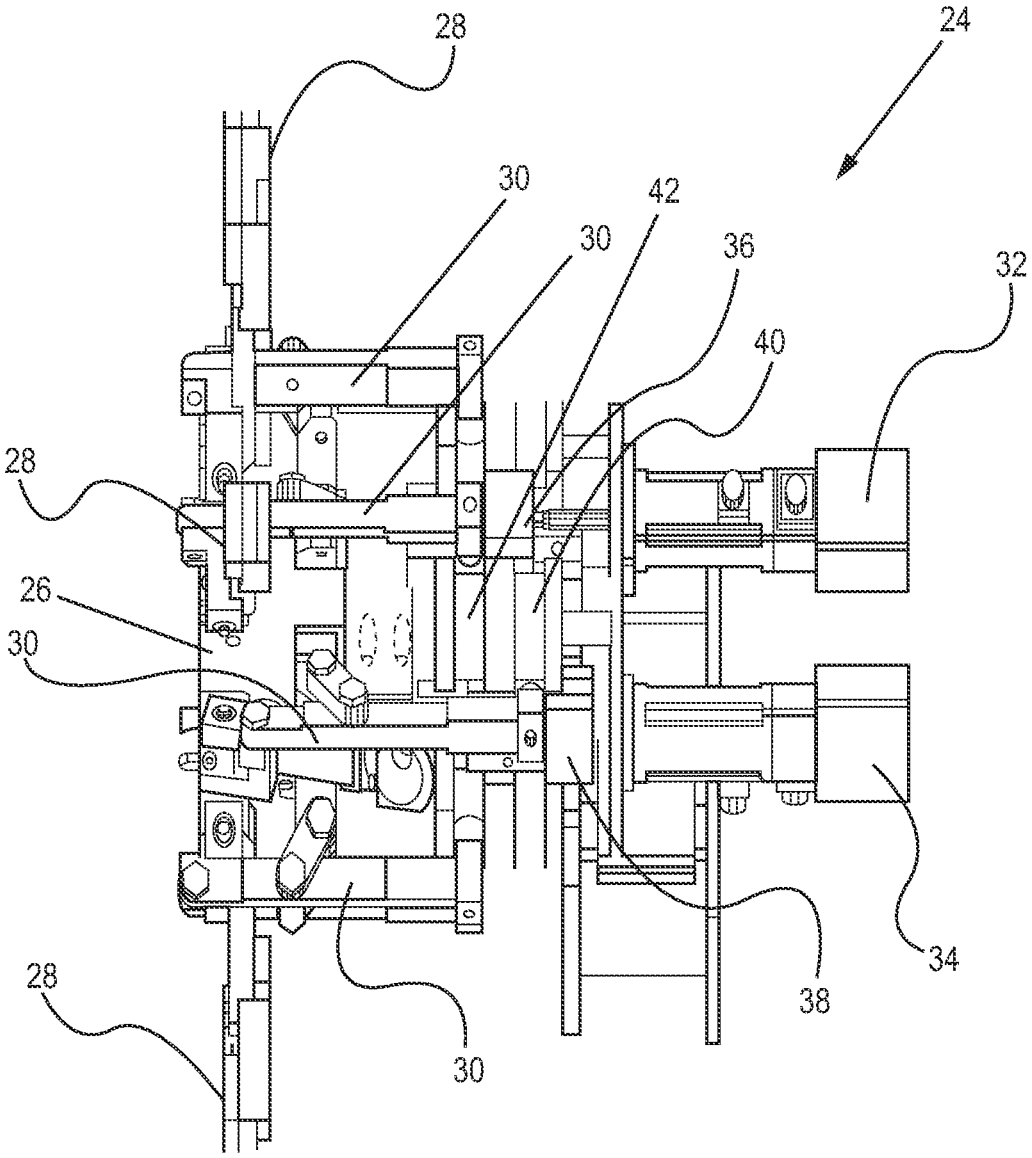
FIG. 6 is an elevational view of an exemplary mandrel cupping assembly of the present disclosure.
Figure 7:
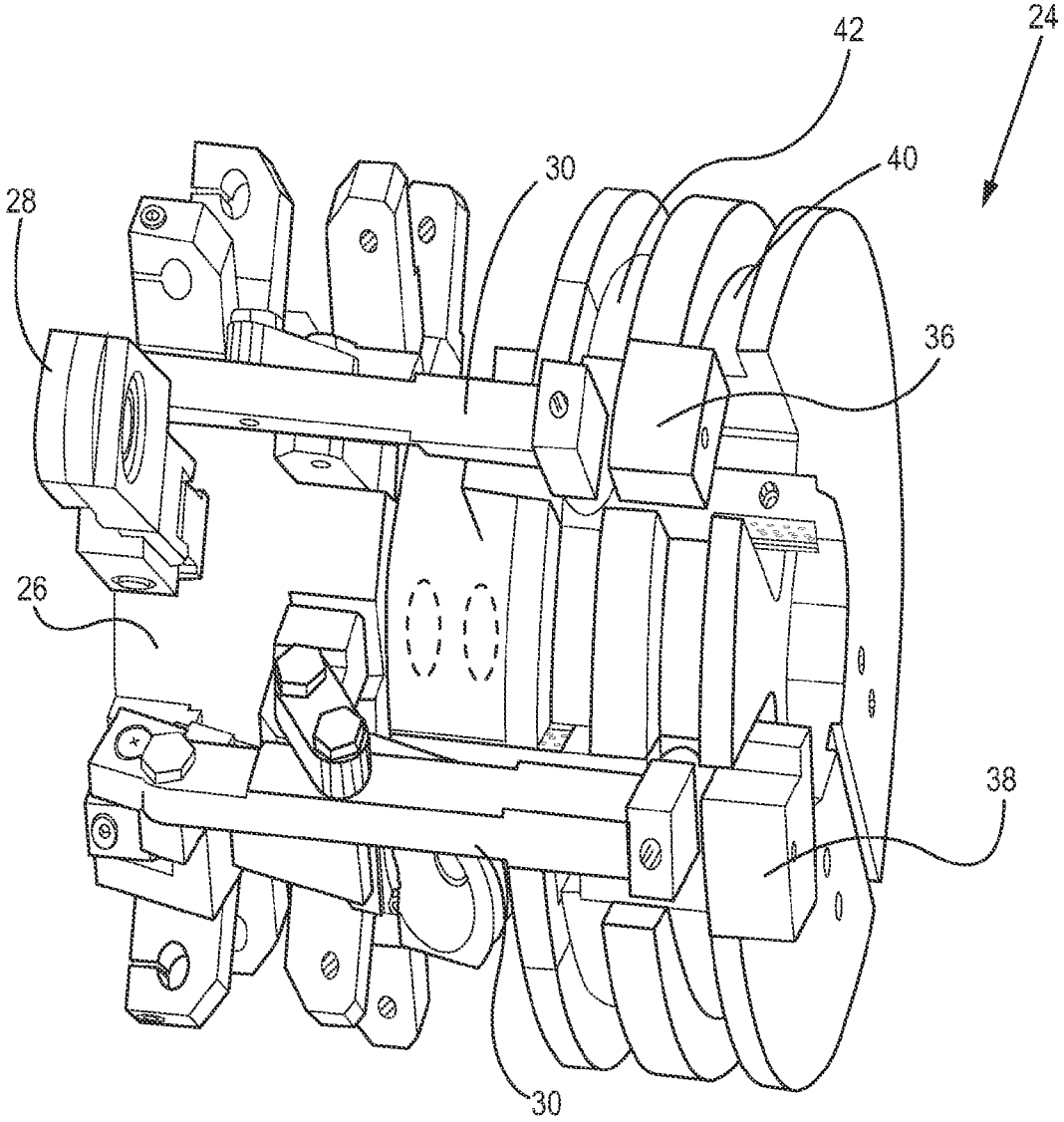
FIG. 7 is an exemplary perspective view of an exemplary mandrel cupping assembly of the present disclosure showing the relationship between the two actuating systems and the cam tracks cooperatively associated thereto.

As shown in FIGS. 2 and 3, once the cupping arm 28 is engaged with the unsupported end of the mandrel 22 after loading of a core upon mandrel 22, it remains in that position until turret assembly 20 indexes to carry the mandrel 22 out of the unload station. Furthermore, as the mandrel 22 moves away from the unloading station and its associated cupping arm 28 and chucking lever is engaged into hold-close cam track 42, which maintains the cupping arm 28 in its engaged position with the supported end of mandrel 22 of turret assembly 20. The turret assembly 20 then indexes the mandrel 22 and associated cupping arm 28 about its longitudinal axis until web product is contactingly engaged with the core disposed upon the mandrel 22. At this point, mandrel 22 is spun up and as discussed supra coincides with the winding of web material about the core disposed about mandrel 22 to form wound product 46.

In one embodiment, it may be preferred to provide for a gap in hold-close cam track 42 at a point after the cupping activator 32 engages cupping shuttle 36, thereby engaging the respective chucking lever 30 to cause cupping arm 28 to engage the respective mandrel 22. It is believed that providing such a gap can facilitate and enable disengagement of the cup from the respective mandrel 22 manually. This can be useful in the event there is a machine jam, the respective core has not been disposed upon a given mandrel 22, to conduct routine maintenance, and the like. If desired, the opening in the hold-close cam track 42 can be blocked to prevent accidental disengagement of the cup from the respective mandrel 22.

Upon reaching the unload station, un-cupping activator 34 is engaged with chucking lever 30 and ergo chucking arm 28, through un-cupping shuttle 38, to retract cupping atm 28 from contacting engagement with mandrel 22 and depositing the cam associated with cupping arm 28 into hold-open cam track 40. Deposition of cupping arm 28 into hold-open cam track 40 then allows cupping spider 26 of cupping assembly 24 to rotate about its longitudinal axis coincidentally with mandrel 22 of turret assembly 20 formerly cooperatively associated thereto to a position where the core having wound product 46 disposed thereon can be removed from the particular mandrel 22. The cupping aim 28 for the mandrel 22 moving from the unloading station to the loading station this remains open so that it can clear any required supports. The referenced cupping aim 28 can then freely rotate about the axis of cupping assembly 24 and hold open cam track 40 in preparation for movement of the next mandrel 22 into the unloading station and egress of the subject mandrel 22 from the unloading station.

By reference, a core may be started onto the mandrel 22 at the loading station by means of a core loading apparatus (not shown) as would be known by those of skill in the art. After the core has run onto the mandrel 22 a known distance, the core is engaged by a rotating loading wheel known to those of skill in the art that initially cooperates with the core loading apparatus and moving the core onto the mandrel 22 but which takes over the propulsion of the core in the last part of movement onto the mandrel 22.

Further, as would be known by those of skill in the art, when a core is properly positioned on the mandrel 22, its front end engages in an abutment located near the spider supporting the mandrels 22 of turret assembly 20. After it engages the abutment, the core cannot be advanced any further by the rotating core loading wheel which would then merely slip relative to the core. At about the time that the core engages the abutment, its front end portion moves under an arm that typically comprises a core detector. Such an apparatus may comprise a spring arm having a free end portion that is biased towards contacting engagement with the mandrel 22 at the loading station and a properly loaded core intervenes between the associated spring aim and the mandrel 22 to break contact between them and thus open an electric signal circuit through the spring arm. As would be known by those of skill in the art, interruption of the circuit typically comprising an output signifying core presence can cause rotation of the associated core loading wheel to be stopped and engagement of a cupping arm 28 upon the mandrel 22 by operation of the cupping activator 32 causing chucking lever 30 connected to cupping arm 28 to engage the unsupported end of mandrel 22 having the core disposed thereupon. Such a core presence signal can also be issued to a PCD, PLC, or other synchronizing mechanism for the apparatus and its issuance is in any case a condition or the condition for retraction of the cupping shuttle 36 at the appropriate loading station. Such retraction, as pointed out above, constitutes a closing input to the control element for the cupping arm 28 to swing back into contacting engagement with its respective mandrel 22. Thus, the cupping arm 28 is closed only if and when a core is present on the mandrel 22 at the loading station and before the mandrel 22 begins to move out of that station.

It should be realized by one of skill in the art that engagement of the cupping arm 28 upon the mandrel 22 could also occur just prior to any core presence signal being detected. It should be recognized that the core should be clear of the cupping arm 28 before the cupping arm 28 moved toward the mandrel 22.

In a preferred embodiment, since the cupping arm 28 can be moved into a closed position where contacting engagement occurs between the cupping arm 28 and the respective mandrel 22 and likely after the mandrel 22 has been subjected to vibration dampening, it is unlikely that the conical end portion typically associated with the mandrel 22 will fail to seat in the bearing socket of the cupping arm 28. However, in the event of such a failure, the cupping actuator 32 can be programmed to merely stop short of its limit position at which the cupping arm 28 is closed, thus eliminating damage that can result because the cupping arm 28 will be urged past the stationary mandrel 22 under yielding pressure from cupping actuator 32.

Figure 8:
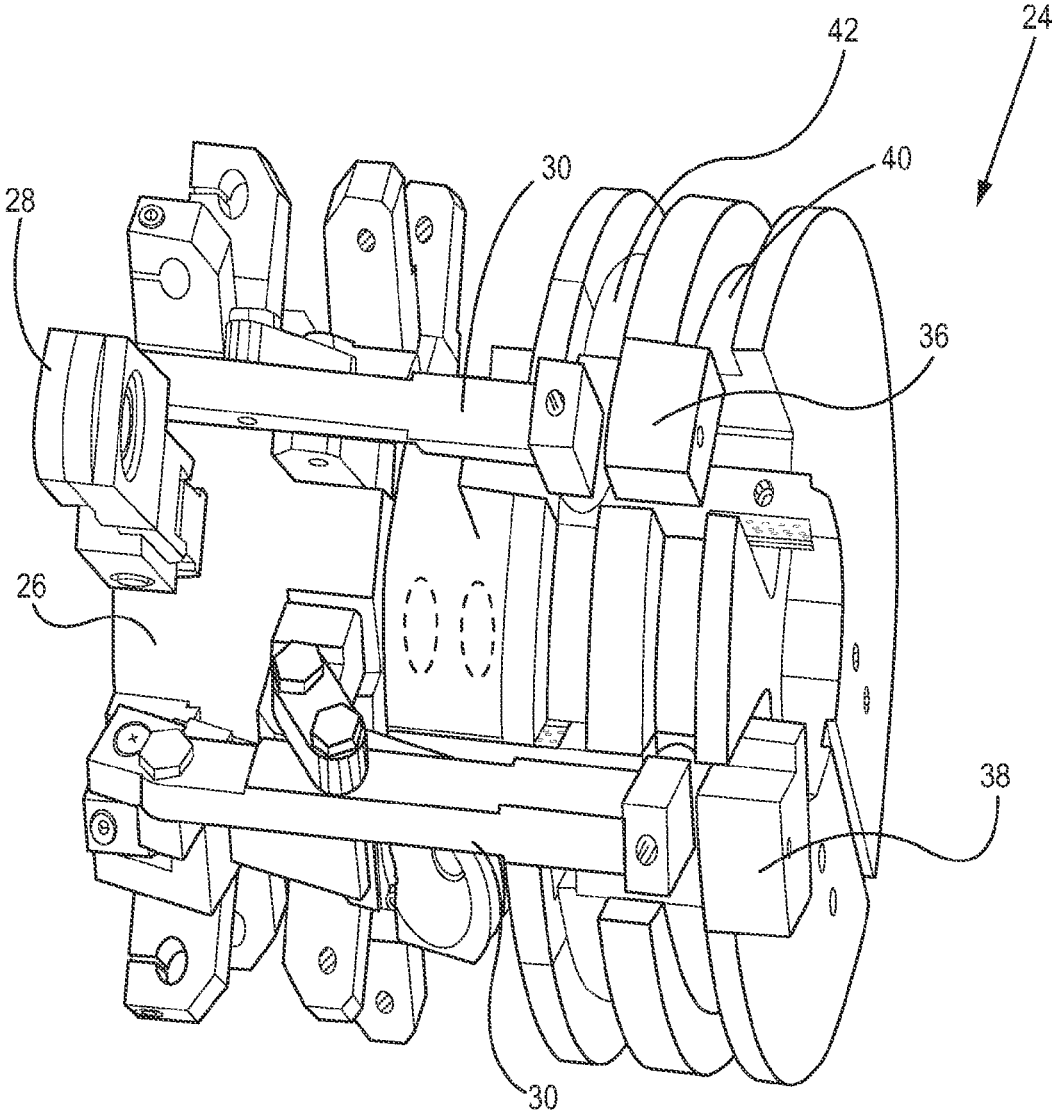
FIG. 8 is an exemplary perspective view of an exemplary mandrel cupping assembly of the present disclosure showing engagement and disengagement of the mandrel actuators and their relationship to the cams of the mandrel cupping assembly.
Figure 9:
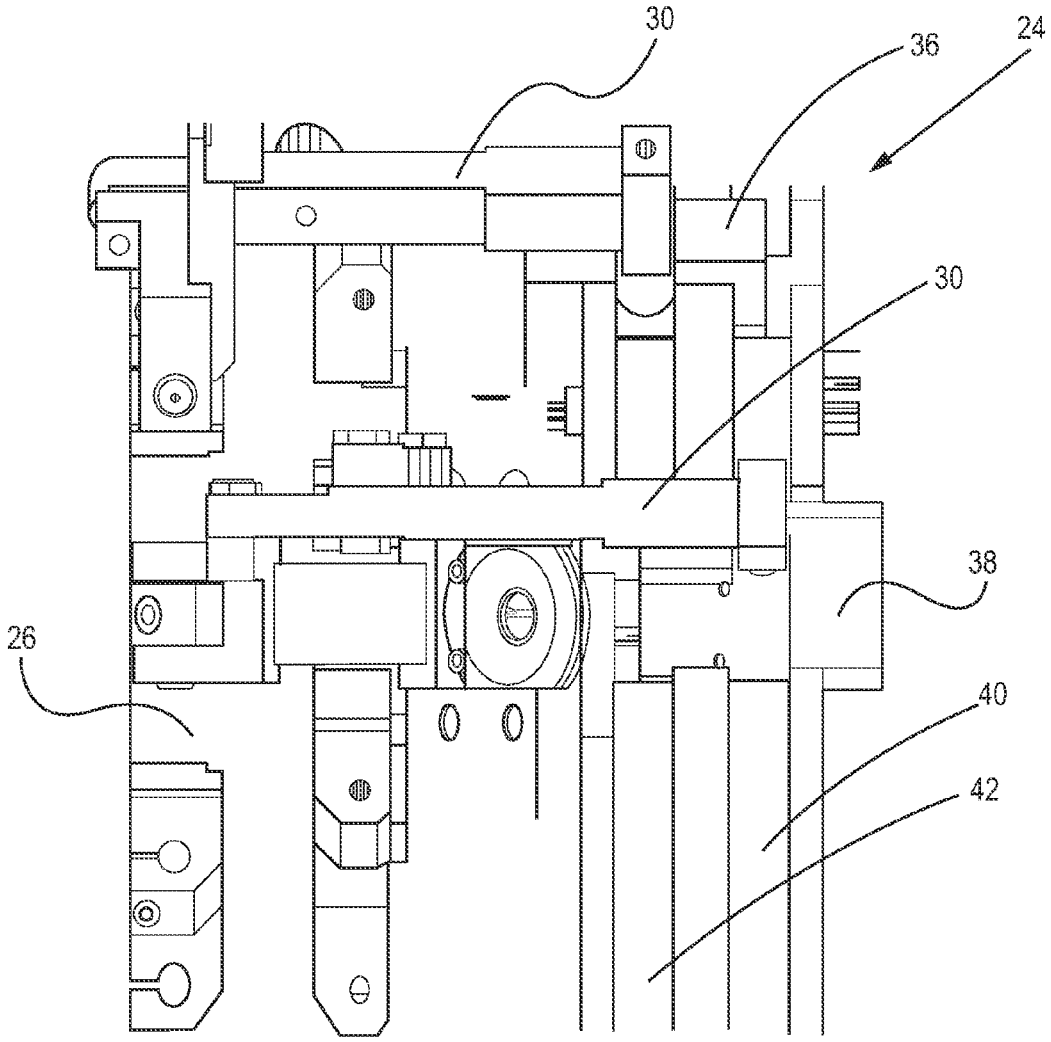
FIG. 9 is an exemplary expanded view of a disengaged actuator showing the relationship between the disengaged mandrel cup and the cam track of the mandrel cupping assembly.

One of skill in the art will understand that each of the cupping shuttle 36 and un-cupping shuttle 38 is generally provided with a slot through the middle of the cupping shuttle 36 and/or un-cupping shuttle 38. In this regard, the respective cupping aim 28 disposed in hold-open cam track 40 or hold-closed cam track 42 can move easily into either segment as the turret assembly 20 is manually indexed in either direction. It was found that this allows the turret assembly 20 to be manually rotatable without needing to activate the cupping shuttle 36 and/or un-cupping shuttle 38. Such a configuration is shown in FIGS. 8-10 respectively. This is advantageous in the event of an electric power failure or power disconnect leaving both shuttles in their resting positions.

It is also likely that one of skill in the art will understand that each of the cupping shuttle 36 and un-cupping shuttle 38 is provided with a beveled or inclined ramp portion along its edge remote from the other so that in the event of an electric power failure, which could leave both shuttles in their fully extended condition, the respective cupping arm 28 disposed in hold-open cam track 40 or hold-closed cam track 42 can move easily into either segment as the turret assembly 20 is manually indexed in either direction. It was found that this allows the turret assembly 20 to be manually rotatable without needing to activate the cupping shuttle 36 and/or un-cupping shuttle 38. Such a configuration is shown in FIGS. 8-10 respectively.

Any dimensions and values disclosed herein are not to be understood as being strictly limited to the exact dimension and values recited. Instead, unless otherwise specified, each such dimension and/or value is intended to mean both the recited dimension and/or value and a functionally equivalent range surrounding that dimension and/or value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A mandrel cupping assembly for releaseably engaging unsupported ends of a plurality of mandrels disposed on a web winding turret assembly, said turret assembly comprising a plurality of mandrels extending parallel to a turret assembly central axis and driven in a closed mandrel path about said turret assembly central axis, said mandrel cupping assembly comprising:

a cupping arm cooperatively associated with each mandrel of said plurality of mandrels, said cupping arm being capable of releaseably engaging said unsupported end of said mandrel;

a cupping spider having a hold-open cam track and a hold-closed cam track disposed radially and formed in a surface thereof, each cupping arm being cooperatively associated with a respective chucking lever, each chucking lever providing connective engagement of each respective cupping arm with either of said hold-open cam track or said hold-closed cam track, each of said cupping arms being carried in a radial path about said turret assembly central axis while said respective chucking lever cooperatively associated thereto is disposed in either of said hold-open cam track or said hold-closed cam track; and, a first actuator for disposing said cupping arm from said hold-open cam track to said hold-closed cam track.

2. The mandrel cupping assembly of claim 1 wherein disposing said respective chucking lever from said hold-open cam track to said hold-closed cam track further comprises engaging said cupping arm with said mandrel cooperatively associated thereto.

3. The mandrel cupping assembly of claim 2 further comprising a second actuator for disposing said respective chucking lever from said hold-closed cam track to said hold-open cam track.

4. The mandrel cupping assembly of claim 3 wherein disposing said respective chucking lever from said hold-closed cam track to said hold-open cam track further comprises disengaging said cupping arm from said mandrel cooperatively associated thereto.

5. The mandrel cupping assembly of claim 1 further comprising a second actuator for disposing said respective chucking lever from said hold-closed cam track to said hold-open cam track.

6. The mandrel cupping assembly of claim 5 wherein disposing said respective chucking lever from said hold-closed cam track to said hold-open cam track further comprises disengaging said cupping arm from said mandrel cooperatively associated thereto.

7. The mandrel cupping assembly of claim 5 further comprising an un-cupping shuttle cooperatively associated with said second actuator, said un-cupping shuttle providing contacting engagement between said first actuator and a respective chucking lever and a respective cupping arm to displace said respective chucking lever from said hold-closed cam track to said hold-open cam track.

8. The mandrel cupping assembly of claim 1 further comprising a gap disposed between said hold-closed cam track and said hold-open cam track said gap allowing movement of said respective chucking lever from either said hold-closed cam track to said hold-open cam track or said hold-open cam track to said hold-closed cam track.

9. The mandrel cupping assembly of claim 1 further comprising a cupping shuttle cooperatively associated with said first actuator, said cupping shuttle providing contacting engagement between said first actuator and a respective chucking lever.

10. The mandrel cupping assembly of claim 9 further comprising an un-cupping shuttle cooperatively associated with said second actuator, said un-cupping shuttle providing contacting engagement between said first actuator and a respective chucking lever.

11. The mandrel cupping assembly of claim 1 further comprising a cupping shuttle cooperatively associated with said first actuator, said cupping shuttle providing contacting engagement between said first actuator and a respective cupping arm to displace said respective chucking lever from said hold-open cam track to said hold-closed cam track.

12. The mandrel cupping assembly of claim 11 further comprising an un-cupping shuttle cooperatively associated with said second actuator, said cupping shuttle providing contacting engagement between said second actuator and said respective chucking lever.

13. The mandrel cupping assembly of claim 1 wherein said cupping arm and said respective cupping arm cooperatively associated thereto is indexably rotatable about said radial path.

14. The mandrel cupping assembly of claim 13 wherein said cupping arm and said respective cupping arm cooperatively associated thereto is manually advanceable from a first position to a second position about said radial path.

15. The mandrel cupping assembly of claim 1 wherein said first actuator is fixably disposed upon said cupping spider relative to said hold-open cam track.

16. The mandrel cupping assembly of claim 1 wherein said cupping arm cooperatively associated with each mandrel dwells in each of a plurality of positions about said cupping spider.

17. The mandrel cupping assembly of claim 16 wherein one of said plurality of positions provides for disposition of a core upon one of said plurality of mandrels when said cupping respective chucking lever cooperatively associated with said respective cupping arm cooperatively associated with each of said mandrels is disposed in said hold-open cam track.

18. The mandrel cupping assembly of claim 17 wherein a second of said plurality of positions provides for disposition of a web substrate upon said mandrel when said respective chucking lever cooperatively associated with said respective cupping arm cooperatively associated with each of said mandrels is disposed in said hold-closed cam track.

19. The mandrel cupping assembly of claim 18 wherein at least one of said plurality of positions provides for removal of said web material convolutely wound about said mandrel when said respective chucking lever cooperatively associated with said respective cupping arm cooperatively associated with each of said mandrels is disposed in said hold-open cam track.

* * * * *